United States Patent [19]

Sugahara et al.

[11] 4,446,805

[45] May 8, 1984

[54] DECK CONSTRUCTION FOR REFRIGERATED CARGO SHIPS

[75] Inventors: Byron M. Sugahara, Bloomfield, N.J.; Avrum A. Freelund; George Zinger, both of New York, N.Y.

[73] Assignee: Reefer Express Lines Pty., Ltd., Roseland, N.J.

[21] Appl. No.: 277,272

[22] Filed: Jun. 25, 1981

[51] Int. Cl.[3] ..... F26B 19/00

[52] U.S. Cl. ..... 114/76; 98/6; 62/240

[58] Field of Search ..... 114/72–76, 114/85; 98/6, 8, 33, 31, 40 D; 62/418, 240

[56] References Cited

U.S. PATENT DOCUMENTS

| | | | |
|---|---|---|---|
| 2,258,402 | 10/1941 | Baillie | 62/418 |
| 2,616,529 | 11/1952 | MacDonald | 98/31 |
| 3,366,013 | 1/1968 | Madl | 98/31 |
| 3,903,660 | 9/1975 | Akins | 98/40 D |
| 4,168,581 | 9/1979 | Thode | 114/76 |

*Primary Examiner*—Trygve M. Blix
*Assistant Examiner*—Stephen P. Avila

[57] ABSTRACT

A deck construction for refrigerated cargo ships for tween decks in which a longitudinally-extending insulated corrugated member provides a series of alternate V-shaped longitudinally-extending channels for supply air and an intermediate series of inverted V-shaped longitudinally-extending channels for return air, and a grating mounted on the longitudinally-extending corrugated member through which grating at least some supply air may flow upwardly.

5 Claims, 3 Drawing Figures

DECK CONSTRUCTION FOR REFRIGERATED CARGO SHIPS

BACKGROUND AND OBJECTIVES OF THE INVENTION

In refrigerated cargo ships carrying a general cargo, as opposed to containerized cargo, the general method of cooling the holds is essentially that each of the holds has a fan room or cooling room at one end. The holds are divided from each other by substantially air-tight decks. In the cooler rooms, there is a series of fan batteries which discharge air downwardly through cooling coils into a plenum chamber which extends substantially the full width of the ship. Cool air supply leaves the plenum chamber and enters the fore and aft passageways in the deck of the compartment with the supply of cooler air travelling from the fan room towards the opposite end of the hold. All along the length of the hold, the cooler air emerges from the deck through a series of perforations in the upper surface of the deck. The air flows upward through the cargo to the upper portion of the hold and then in the clear space above the cargo flows back to the fan room and through screened openings in the upper part of the fan room bulkhead and then back to the fans.

In all refrigerated (reefer) ship designs, the refrigerated decks generally incorporate a conventional structural concept for flat steel decks. These conventional decks have as their upper structural boundary a steel plate surface which is supported from below by an arrangement of fore and aft and transverse beams of varying depths. The longitudinal passageways for the chilled or cooled air are formed by fore and aft bearers on the upper surface of the steel plate deck. These bearers may be either steel or wood and they support a grating deck generally of perforated plywood. There are also some systems which utilize special aluminum sections to form both the bearers and the grating surface. However, in all of these systems, the bearers do not contribute to the structural strength of the deck or of the ship but serve only as spacers and supports between the steel deck surface and the grating deck. The reason that the decks employing even steel longitudinals cannot treat the longitudinals as strength members of the deck or of the hull is that the longitudinals are not supported by brackets along their length (since these would interfere with the required air flow) and are not considered to be adequately stable for use as structural members.

Therefore, it is an objective of this invention to overcome the inadequacies of the prior deck construction for refrigerated cargo ships by employing a folded steel plate which forms the deck membrane and extends longitudinally forming an alternate series of longitudinally-extending V-shaped channels and a series of inverted V-shaped longitudinally-extending channels through which V-shaped channels cool supply air may flow, and through which inverted V-shaped channels return air may flow.

It is a further objective of this deck construction to provide additional bending strength along the length of the folds and to provide added strength in the transverse direction and to break the span in the longitudinal direction by introducing trusses into the deck structure.

Yet a further objective of this invention is to incorporate a uniform depth to the entire deck structure with longitudinal and transverse members equal in depth and contained, in effect, within each other.

Furthermore, it is an objective of this invention to incorporate the members forming the structure of the deck to form also the air circulation channels.

Another objective and advantage of this deck construction is that the corrugations provide sufficient stiffness in bending to permit the corrugated plate to be viewed as a series of connected beams or girders. The deck construction provides a truss structure perpendicular to the length of the corrugations thereby furnishing the necessary stiffness and support required.

A further advantage of this invention is the ability to incorporate a truss structure within the overall depth of the corrugations by utilizing the corrugated plate itself with the requisite stiffness in the manner of the transverse truss to provide the lacing, or shear transmitting structure, necessary to permit the upper and lower flanges to act as an integrated truss resulting in a structure having a means of simply providing unobstructed longitudinal passages.

SUMMARY OF THE INVENTION

A deck construction for tween decks for refrigerated cargo ships in which a corrugated plate forms a structural member and provides longitudinally-extending channels for the flow of cool supply air in one direction and channels for returned air with supporting means for retaining a grating above the corrugated member through which a plurality of openings may be provided for the distribution of cool air supply from channels formed in the corrugated member. The provision of the improved deck construction of the present construction avoids the blockage of supply or return air flow by vertical webs in transverse structural members by adopting a straightforward manner of supplying and returning air through spaced channels which do not interfere one with the other. There is considerable saving in the overall height of the ship which can be achieved without reducing the volume of cargo that may be stowed.

DETAILED DESCRIPTION OF PREFERRED EMBODIMENTS

Figure 1:
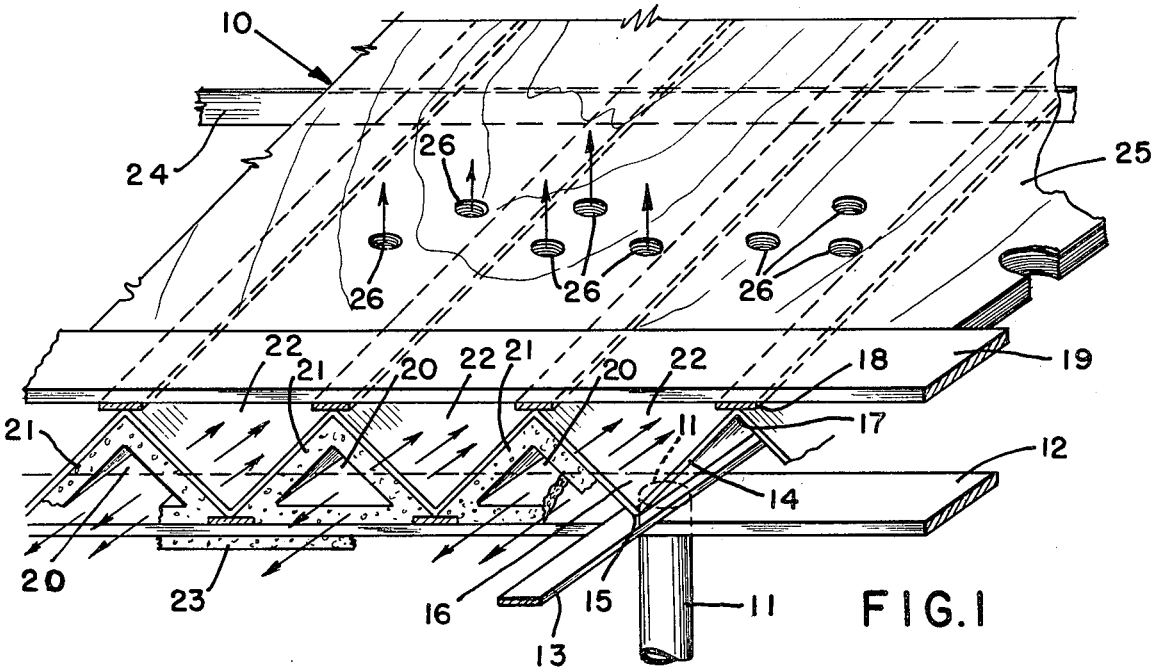
FIG. 1 is a perspective view, partly in section, illustrating one embodiment of a deck construction of this invention.
Figure 2:
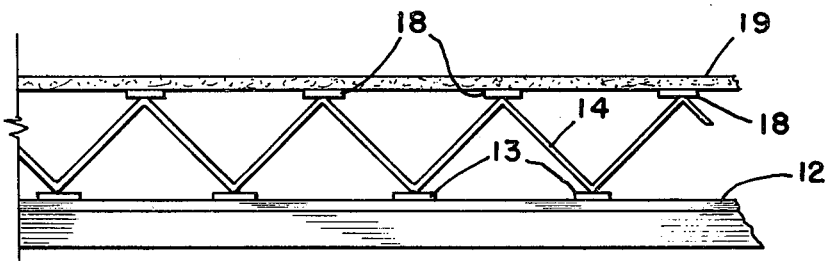
FIG. 2 is a front elevational view of the embodiment shown in FIG. 1.

Referring to the drawing and particularly to FIGS. 1 and 2, there is illustrated in FIG. 1 a partial tween deck section 10 for a refrigerated cargo vessel in which the vertical support member 11 is securely fastened to the deck below (not shown) with the upper end 11 secured to the lower flange 12 that extends transversely to support the longitudinally-extending flat bar 13 which is secured, as by welding to the longitudinally-extending corrugated member 14 at the base or apex 15 of the right longitudinally-extending channel 16 through which channel cool supply air will flow.

At the upper vertex 17 formed in the corrugated member 14, a flat bar 18 is secured and extends longitudinally below the upper flange 19 that extends transversely over the corrugated member 14.

The corrugated member 14 is preferably fabricated of metal to serve as a support structural member and may be provided throughout its undersurface in the inverted V-shaped channels 20 with insulation 21 of a suitable depth depending upon the temperatures between the incoming cool supply air which flows through the V-shaped longitudinally-extending channels 22 which are arranged in series that alternate with the intermediate inverted V-shaped longitudinally-extending channels 20 through which the return air is supplied.

Additional insulation 23 may be secured around the lower flange member 12 with the insulation 21 extending longitudinally throughout the inverted V-shaped channels 20 in the corrugated member 14. The thickness of the corrugated member 14 and the dimensions and proportions of the corrugations will vary depending upon the loads to which the structure may be subjected. The thickness of the corrugated member 14 may be increased locally in way of the upper and lowe truss flanges, 19 and 12 respectively.

Transversely extending spacer or bearer members 24 are spaced longitudinally from each other throughout the extent of the longitudinally-extending corrugated member to locate the individual panels of a plywood grating 25 which may be suitably treated to be water resistant. The thickness of the grating 25 will also vary depending upon the load to which the plywood grating may be subjected. The grating 25 is provided with a series of openings 26 through which openings 26 cool supply air may flow therethrough from the V-shaped channels 22 below with the openings 26 extending longitudinally through the grating at suitable spaced intervals.

As shown in FIG. 2, the corrugated member 14 without any insulation mounted thereon extends transversely of the hold with the longitudinally-extending flat bars 13 and 18 being mounted suitably at the apex of the intersection of the V or inverted V positions of the corrugated member 14 to support the lower flange 12 and the upper flange 19 in position.

Figure 3:
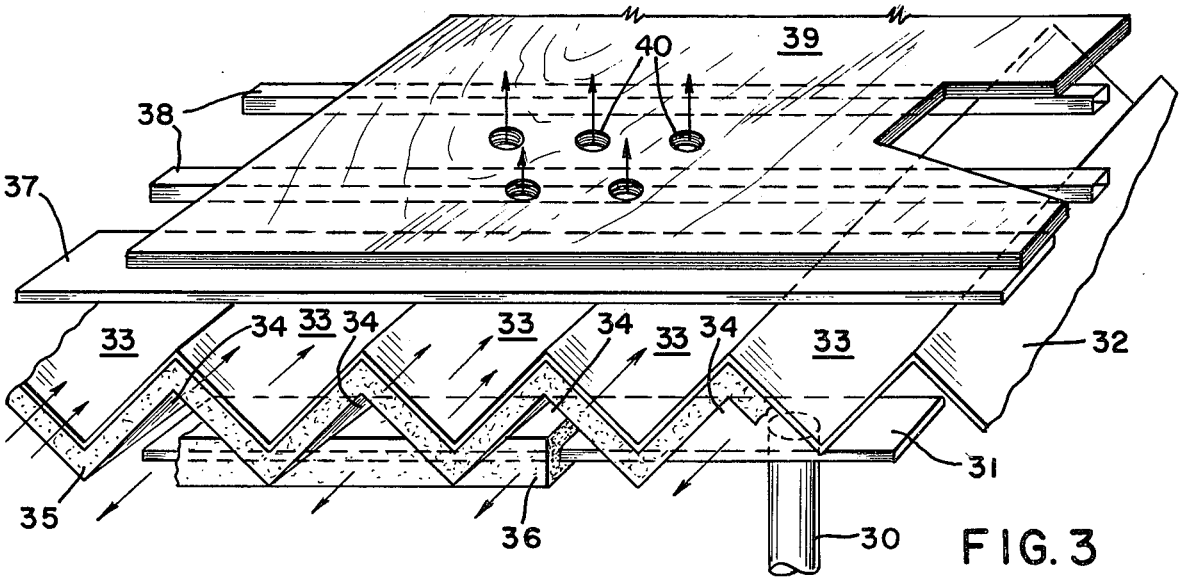
FIG. 3 is a perspective view, partly in section, showing a modified embodiment of a deck construction of this invention.

Referring to FIG. 3, there is illustrated a modified embodiment of the invention in which the vertically supported member 30 supports the lower flange 31 of the transverse truss construction in which the corrugated member 32 extends longitudinally throughout the hold with an alternate series of V-shaped longitudinally-extending channels for the introduction of cool air supply with an intermediate series of inverted V-shaped longitudinally-extending channels 34 from which return air is supplied to the fan room (not shown). A suitable thickness of insulating material 35 may be secured to the bottom portions of the corrugated member 32 with additional insulation 36 surrounding the lower flange 31.

An upper flange member 37 extends transversely across the longitudinally-extending corrugated member 32 forming with the lower flange 31 and the corrugated member 32 a transverse truss. Bearer members 38 extend transversely across the corrugated member 32 and are longitudinally-spaced from each other throughout the longitudinal extent of the corrugated member 32.

The plywood grating 39 is supported directly on the upper flange 37 and the bearer members 38 and thereby omitting in this embodiment the necessity for including the longitudinally-extending bars 13 and 18 employed in the embodiment illustrated in FIGS. 1 and 2.

The grating 39 is provided with a plurality of openings 40 therethrough which communicate with the channels 33 for the flow of cool air vertically at spaced intervals through the grating 39.

The various flanges, corrugated and bearer members may be suitably welded together and transverse the plywood grating secured by suitable fastening members (not shown) to the upper flange and bearer members 37 and 38, respectively.

The extent of the insulation and the positioning of the upper and lower flanges may vary depending upon the particular installation but it should be taken into consideration that the corrugated member 32 will serve the function of a truss structure and a conduit for the flow of air suitably segregated in the V-shaped and inverted V-shaped channels to offer maximum unobstructed longitudinal passages for the air with the embodiment shown in FIG. 3 also permitting some transverse air flow between the corrugated member and the bottom of the grating which transverse air flow will extend through the hold in the structure. The number of openings 40 and the positioning of them will vary depending upon the particular application and cargo requirements.

I claim:

1. A deck construction for tween decks for refrigerated cargo ships comprising; a vertically-supported structural member, a lower transverse flange supported on said vertically-supported structural member, a corrugated member supported on said transverse lower flange, said corrugated member having an alternate series of longitudinally-extending V-shaped supply air channels and an intermediate series of inverted V-shaped return air channels, an upper transverse flange supported on said corrugated member, a plurality of longitudinally spaced bearer members extending transversely across said corrugated member, and a flat grating supported above said corrugated member.

2. A deck construction for tween decks for refrigerated cargo ships as claimed in claim 1, and insulation mounted on said corrugated member.

3. A deck construction for tween decks for refrigerated cargo ships as claimed in claim 1, and insulation mounted on said corrugated member at least in said inverted V-shaped channels.

4. A deck construction for tween decks for refrigerated cargo ships as claimed in claim 1, said flat grating having a plurality of openings therethrough for distribution of supply air from said longitudinally-extending V-shaped channels.

5. A deck construction for tween decks for refrigerated cargo ships as claimed in claim 1 and longitudinally-extending bars secured to the longitudinally-extending V-shaped and inverted V-shaped channels for contact with said lower and upper transverse flanges.

* * * * *